US007435061B2

(12) United States Patent
Lee

(10) Patent No.: US 7,435,061 B2
(45) Date of Patent: Oct. 14, 2008

(54) SUCTION MUFFLER CONNECTOR AND COMPRESSOR THEREWITH

(75) Inventor: Ho Sung Lee, Ulsan-si (KR)

(73) Assignee: LG Electronics Inc., Seoul (KR)

( * ) Notice: Subject to any disclaimer, the term of this patent is extended or adjusted under 35 U.S.C. 154(b) by 664 days.

(21) Appl. No.: 10/814,181

(22) Filed: Apr. 1, 2004

(65) Prior Publication Data

US 2005/0042113 A1 Feb. 24, 2005

(30) Foreign Application Priority Data

Aug. 18, 2003 (KR) ..... 10-2003-0056834

(51) Int. Cl.
*F04B 39/00* (2006.01)
*F04B 53/00* (2006.01)

(52) U.S. Cl. ..... 417/312; 417/902; 181/403

(58) Field of Classification Search ..... 417/312, 417/902; 181/403
See application file for complete search history.

(56) References Cited

U.S. PATENT DOCUMENTS 5,252,035 A * 10/1993 Lee ..... 417/312
5,988,990 A * 11/1999 Lee ..... 417/312
6,390,788 B1 * 5/2002 Tack ..... 417/312

* cited by examiner

*Primary Examiner*—Devon Kramer
*Assistant Examiner*—Peter J Bertheaud
(74) *Attorney, Agent, or Firm*—Ked & Associates, LLP

(57) ABSTRACT

Suction muffler connector, and compressor therewith, the suction muffler connector in a compressor having a suction pipe for guiding refrigerant into the compressor, and a suction muffler for attenuating noise of the refrigerant in the suction pipe including a connection pipe having one side connected to the suction pipe for guiding the refrigerant to the suction muffler, and a connection pipe fitted to surround the connection spring for preventing exposure of an outside circumference of the connection spring, having a top part held at an inlet to the suction muffler, thereby preventing leakage of refrigerant introduced into the suction muffler.

19 Claims, 6 Drawing Sheets

SUCTION MUFFLER CONNECTOR AND COMPRESSOR THEREWITH

This application claims the benefit of the Korean Application No. P2003-56834, filed on Aug. 18, 2003, which is hereby incorporated by reference.

BACKGROUND OF THE INVENTION

1. Field of the Invention

The present invention relates to compressors for compressing a working fluid such as refrigerant to a required pressure, and more particularly, to a suction muffler connector fitted between the suction muffler and a refrigerant pipe of a compressor for preventing leakage of refrigerant, and a compressor therewith.

2. Background of the Related Art

The compressor compresses the working fluid, such as gas or a refrigerant, to a required pressure. In the compressors, there are turbo compressors, such as axial compressors, and centrifugal compressors, and displacement compressors, such as rotating compressors, and reciprocating compressors.

Of the compressors, the reciprocating compressor has a piston in a cylinder for reciprocating therein to draw gas or refrigerant into the cylinder, and compress, and discharge the gas or refrigerant.

A related art reciprocating compressor (hereafter called as a compressor) is provided with a shell having an upper case, and a lower case, a compressing part in the shell for compressing the refrigerant, and a driving part for driving the compressing part.

The compressing part is provided with a compression chamber for compressing and discharging the refrigerant, a suction muffler for attenuating noise of refrigerant drawn into the compression chamber, and an absorption pipe for guiding the refrigerant to the suction muffler.

A related art suction muffler connector 20 provided between the suction muffler and the suction pipe of the compressor for connecting the suction muffler and the suction pipe will be described, with reference to FIG. 1.

Referring to FIG. 1, the suction muffler 11 has an inlet part 11*a* at one side thereof for connection to a suction pipe 12. The inlet part 11*a* has an insertion hole 11*b* having a sectional area that becomes the larger as it goes toward the suction pipe 12, in which a connection cap 21 having a through hole 21*a*, of the connector 20 to the suction muffler is inserted.

For preventing breaking away of the connection cap 21 from the inlet part 11*a* of the suction muffler, the connection cap 21 has a hook 21*b* at a top thereof for hooking a top end of the inlet part 11*a* of the suction muffler, and the through hole 21*a* of the connection cap has a connection spring 22 inserted therein. The connection spring 22 has one end fixed to a top of the suction pipe 12.

For inserting the connection spring 22 into the connection cap 21, there is a gap 'G' between an outside diameter of an upper part of the connection spring 22, and an inside diameter of the through hole 21*a* of the connection cap 21 to be fit to the connection spring 22.

A process for introducing refrigerant through the related art suction muffler connector 20 will be described.

Low temperature, and low pressure refrigerant is introduced into the shell 1 through the suction pipe 12 from an outside of the compressor. The refrigerant is then introduced into the suction muffler 11 through the connection spring 22 connected to the suction pipe. The connection cap 21 between the connection spring 22 and the suction muffler 11 prevents leakage of refrigerant introduced into the suction muffler 11.

The foregoing related art suction muffler connector is disclosed in Korean Utility Model Registration Nos. 21-184100, and 21-264470.

However, the related art suction muffler connector has the following problems.

First, the gap between the connection spring and the connection cap for convenience of connection causes noise as the vibration taken place in operation of the compressor is transmitted to the suction muffler, to result in the connection cap and the connection spring to hit each other.

Second, the hitting of the connection cap and the connection spring to each other due to vibration from the compressor driving wears an inside surface of the connection cap, to make the gap between the connecting spring and the connection cap greater, resulting in leakage of the refrigerant introduced into the suction muffler.

Third, the hitting between the connection cap and the connection spring during operation of compressor results in, not only wear down of the inside surface of the connection cap, but also deformation of the connection spring, thereby making leakage of the refrigerant introduced into the suction muffler heavier.

Fourth, the transmission of heat generated at the time of operation of the compressor to a major part of the connection spring exposed to an outside of the connection cap heats the refrigerant introduced into a compression chamber to expand before introduction into the compression chamber, that drops a compression efficiency of the compressor.

SUMMARY OF THE INVENTION

Accordingly, the present invention is directed to a suction muffler connector, and a compressor therewith that substantially obviates one or more of the problems due to limitations and disadvantages of the related art.

An object of the present invention is to provide a suction muffler connector which can prevent leakage of refrigerant, drawn from an outside through a suction pipe, in a process of introduction into the suction muffler, and a compressor therewith.

Other object of the present invention is to provide a suction muffler connector which can prevent refrigerant introduced into the suction muffler from being heated by external heat, and a compressor therewith.

Another object of the present invention is to provide a suction muffler connector which can prevent transmission of noise to an outside of the compressor in a process of introduction of refrigerant into the suction muffler.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the suction muffler connector in a compressor having a suction pipe for guiding refrigerant into the compressor, and a suction muffler for attenuating noise of the refrigerant in the suction pipe, includes a connection pipe having one side connected to the suction pipe for guiding the refrigerant to the suction muffler, and a connection pipe fitted to surround the connection spring for preventing exposure of an outside circumference of the connection spring, having a top part held at an inlet to the suction muffler.

The connection spring includes an enlarged part having an outside diameter greater than an inside diameter of a lower end of the connection pipe for holding the lower end of the connection pipe.

The connection pipe includes a holding part having an annular recess for holding the enlarged part of the connection spring. The connection pipe is formed of an elastic material.

The suction muffler connector further includes a connection cap between the connection pipe and a suction muffler inlet, for connecting the connection pipe to the suction muffler.

The connection cap has an upper outside circumferential surface, a suction muffler side, inserted in, and held at the connection cap.

The connection cap includes a hook for hooking an inlet to the suction muffler. The connection cap is formed of an elastic material.

In the meantime, the connection spring has an inside diameter of an upper part thereof of a suction muffler side smaller than an inside diameter of a lower part thereof, or the connection spring has a sectional area for flow of refrigerant, that becomes the smaller as it goes upward to a suction muffler side the more.

The connection spring has an upper part extended to an inside of the suction muffler.

Thus, the present invention can prevent leakage of refrigerant introduced into the suction muffler, as well as heating of the refrigerant by external heat in the course of introduction into the suction muffler, and transmission of noise to an outside of the compressor.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Figure 1:
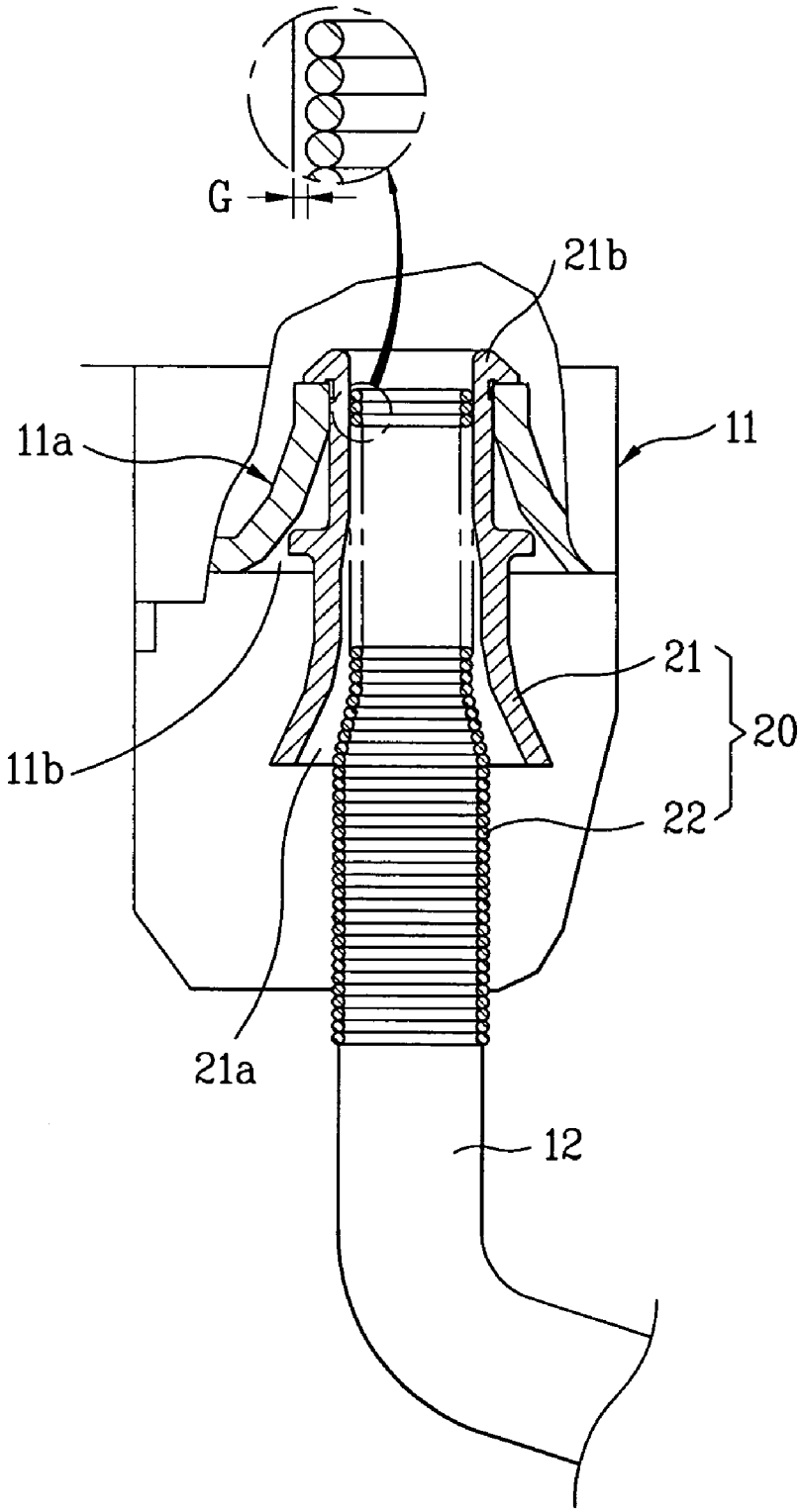
FIG. 1 illustrates a section of a related art suction muffler connector in a compressor.
Figure 2:
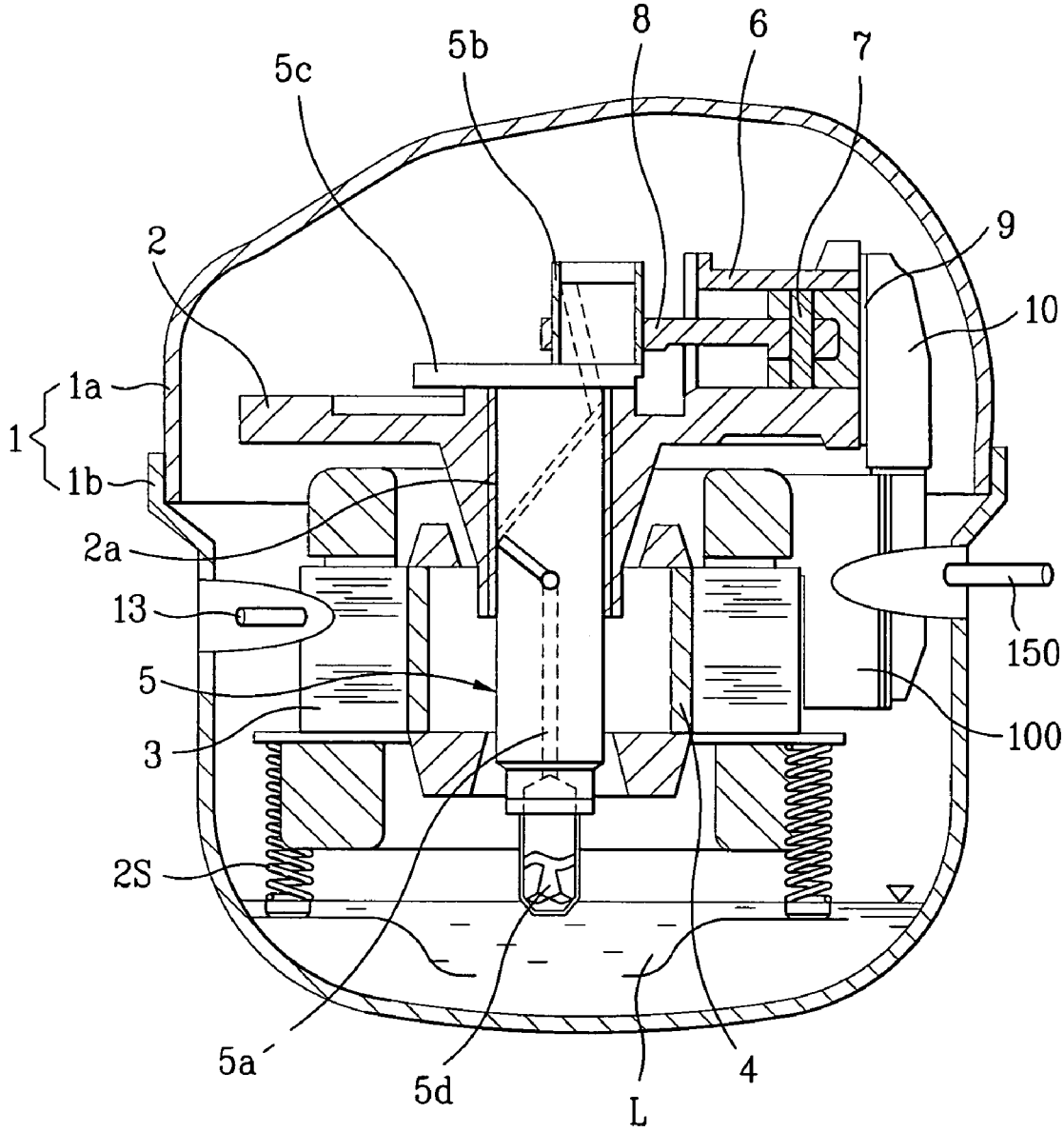
FIG. 2 illustrates a section of a compressor in accordance with a preferred embodiment of the present invention.

Reference will now be made in detail to the preferred embodiments of the present invention, examples of which are illustrated in the accompanying drawings. In describing the embodiments, same parts will be given the same names and reference symbols, and repetitive description of which will be omitted. FIG. 2 illustrates a section of a compressor in accordance with a preferred embodiment of the present invention.

Referring to FIG. 2, the compressor of the present invention includes a shell 1 having an upper case 1*a* and a lower case 1*b*, for holding various components, and a frame 2 supported on springs 2S inside of the shell 1 for fastening various components of the compressor thereto.

There is a boss having a vertical pass through hole in a central part of the frame 2, with a crankshaft 5 rotatably mounted therein.

The crankshaft 5 has an oil passage 5*a*, for guiding oil L held in a bottom part of the shell 1 to an upper part of the shell, and spraying the oil onto the frame 2. There is a pumping mechanism 5*d* at a lower end of the crankshaft 5 for pumping the oil 'L' to the oil passage 5*a*.

The crankshaft 5 rotates by a motor part having a stator 3 and a rotor 4 fixed to the crankshaft 5 for rotating by an electrical interaction with the stator 3, under the frame.

There is a crank pin 5*b* on top of the crankshaft 5 eccentric from a rotation center of the crankshaft 5. There is a balance weight 5*c* opposite to the crank pin 5*b*, for making a rotation speed of the crankshaft 5 uniform.

There is a cylinder 6 formed as one unit with the frame 2 at one side of an upper part of the shell, with a compression chamber formed therein. There is a piston 7 in the cylinder for compression of refrigerant or gas, connected to the crank pin 5*b* at top of the crankshaft 5 with a connecting rod 8 that converts rotating movement of the crankshaft to a linear movement.

There is a valve assembly 9 on the cylinder 6 for controlling flow of refrigerant into/out of the compression chamber. The valve assembly 9 includes a suction valve for drawing refrigerant, and a discharge valve for discharging compressed refrigerant.

The valve assembly 9 has a head cover 10, for isolating the refrigerant drawn into the compression chamber, and the refrigerant discharged from the compression chamber.

In the meantime, there are a suction muffler 100 under the head cover 10 having one side connected to the suction pipe 150 for drawing refrigerant from an outside of the compressor, for attenuating noise of refrigerant transmitted to the compression chamber, and a discharge silencer (not shown) above the frame for attenuating noise of the refrigerant discharged from the compressor.

Figure 3:
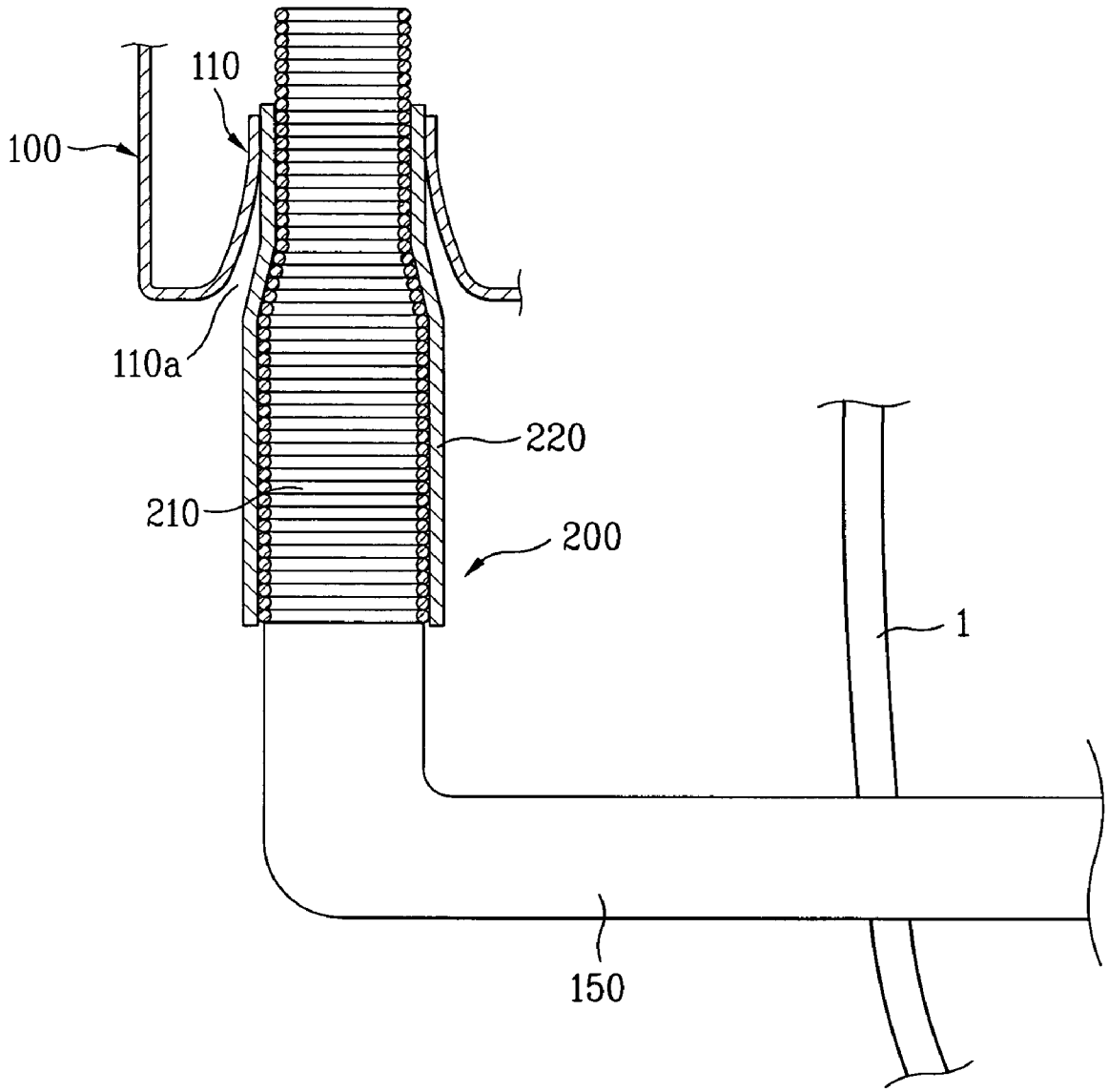
FIG. 3 illustrates a section of a first embodiment suction muffler connector in a compressor of the present invention.

FIG. 3 illustrates a section of a first embodiment suction muffler connector in a compressor of the present invention.

Referring to FIG. 3, the suction muffler 100 for attenuating noise of refrigerant introduced into a compression chamber has an inlet part 110 of the suction muffler at one side thereof for receiving refrigerant from a suction pipe.

In more detail, the inlet part 110 of the suction muffler 100 has one end bent into an inside of the suction muffler 100 from one side surface of the suction muffler 100, and the other end extended to an inside of the suction muffler. Moreover, the other end of the inlet part 110 of the suction muffler, an inner end, has a vertical through hole 110*a* for making inside and outside of the suction muffler 100 in communication, with a diameter of the through hole 110*a* become the smaller as it goes the more to inward.

There is the suction pipe 150 in a lower part of the suction muffler 100 for introducing refrigerant from an outside to an inside of the shell 1. There is a suction muffler connector 200 between the inlet part 110 of the suction muffler and the suction pipe 150 for guiding the refrigerant from the suction pipe 150 to the suction muffler 100.

The suction muffler connector 200 includes a connection spring 210 having one end connected to the suction pipe for guiding the refrigerant into the suction muffler, and a connection pipe 220 for shielding an outside circumferential surface of the connection spring.

In more detail, the connection spring 210 has one end connected to a top part of the suction pipe 150, and the other end extended to an inside of the suction muffler 100 through the pass through hole 110*a* in the inlet part of the suction muffler. The connection pipe 220 is fixed to the inlet part 110 of the suction muffler, and preferably surrounds the connection spring 210 for preventing exposure of the outside circumferential surface of the connection spring 210.

The connection spring 210 may be a coil spring. The connection spring has an upper part inserted in the suction muffler 100, with a diameter smaller than a diameter of a lower part connected to the suction pipe. The connection spring 210 is formed thus for preventing heating of the refrigerant by making a speed of the refrigerant drawn into the suction muffler 100 through the suction pipe 150 faster, to increase a density of the refrigerant drawn into the suction muffler 100, and to shorten a time period in which the refrigerant is exposed to an external heat in the process of introduction into the suction muffler 100.

It is preferable that the connection pipe 220 is formed of plastic having elasticity, particularly, elastic member, such as elastic rubber.

Thus, as the connection pipe 220 surrounds the connection spring 210, the suction muffler connector 200 of the present invention is formed.

The suction muffler connector 200 provided between the suction pipe 150 and the suction muffler 100 enables the refrigerant introduced into the suction muffler 100 without leakage through the connection spring 210.

The suction muffler connector 200 is provided to the compressor by fabricating the connection spring 210 and the connection pipe 220 separately, inserting the connection spring 210 into the connection pipe 220, and assembling.

The connection spring 210 is fabricated by winding thin wire to a required number. In this instance, by winding a part to be inserted in the suction muffler 100 to a relatively smaller diameter, the connection spring 210 of the suction muffler connector 200 of the present invention is fabricated. However, the upper part of the connection spring 210 may be formed to have a diameter smaller than the lower part by applying an external force to the upper part of a cylindrical coil spring, or enlarging the lower part of the coil spring having a smaller diameter.

It is preferable that the connection pipe 220 is formed by injecting plastic raw material with elasticity into a mold, and heating or pressing the mold. However, the connection pipe 230 may be formed by machining plastic.

By inserting the connection spring 210 formed thus into the connection pipe 220 from a lower side of the connection pipe 220 starting from an upper end of the connection spring 210, the suction muffler connector 200 is fabricated.

As other method for fabricating the suction muffler connector 200, plastic may be injected between the connection spring and the mold in a state the connection spring 210 formed as above is placed in a mold.

Fabrication of the suction muffler connector 200 is not limited to above methods, but a variety of methods may be selected.

A process for providing the suction muffler connector 200 between the suction muffler 100 and the suction pipe 150 will be described.

At first, after the suction pipe 150 is provided at one side of the shell 1, the suction muffler connector 200 is fixed to top of the suction pipe 150. In more detail, by fixing the suction pipe 150 to the connection pipe 210 inside of the suction muffler connector 200, the suction muffler connector 200 and the suction pipe 150 are connected to each other.

Under a state the suction pipe 150 and the suction muffler connector 200 are connected to each other, by inserting top end of the suction muffler connector 200 into the inlet part 110 of the suction muffler 100 fastened to the frame, to fix the suction muffler connector 200 elastically, the suction muffler connector 200 is mounted on the suction muffler 100.

Once the suction muffler connector 200 is mounted between the suction muffler 100 and the suction pipe 150, the refrigerant drawn through the suction pipe 150 can be introduced into the suction muffler 100 directly through the suction muffler connector 200.

Since exposure of an outside circumferential surface of the connection spring 210 is prevented by the connection pipe 220, and the refrigerant introduced from the suction pipe 150 is drawn into the suction muffler 100 at a high speed through a flow passage made smaller in the upper part of the connection spring, the leakage of the refrigerant, or heated by an external heat during the introduction of the refrigerant are prevented.

In addition to this, the connection spring 210 may have an enlarged part 210*a* in a lower part, i.e., a part connected to the suction pipe 150. The enlarged part 210*a* may be formed by enlarging a lower end of the connection spring 210 to outward, or attaching or fixing an additional member to the lower end of the connection spring 210.

The enlarged part 210*a* at the lower end of the connection spring 210 supports the lower end of the connection pipe 230, to prevent movement of downward movement of the connection pipe 220. A second embodiment suction muffler connector 200 having the enlarged part 210*a* that thus supports the lower end of the connection pipe is illustrated in FIG. 4.

Figure 4:
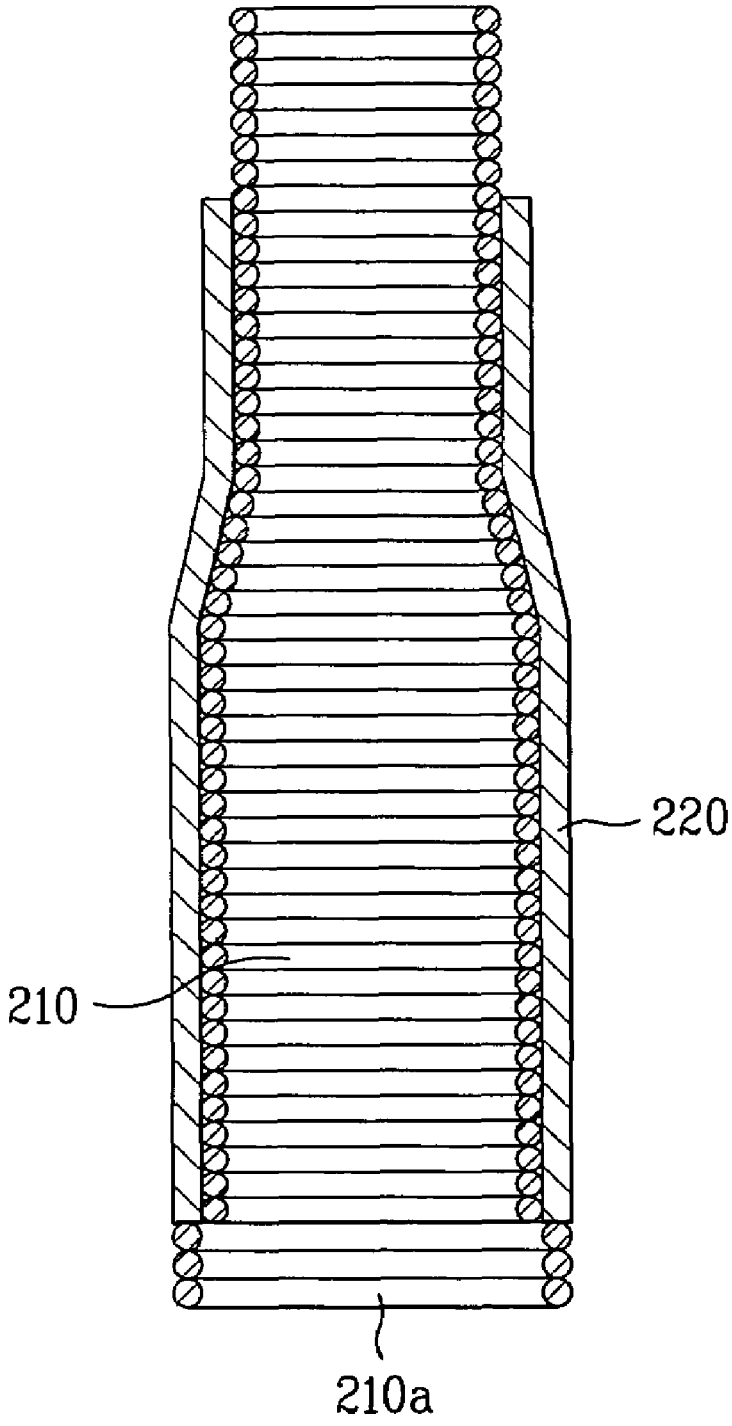
FIG. 4 illustrates a section of a second embodiment suction muffler connector in a compressor of the present invention.
Figure 5:
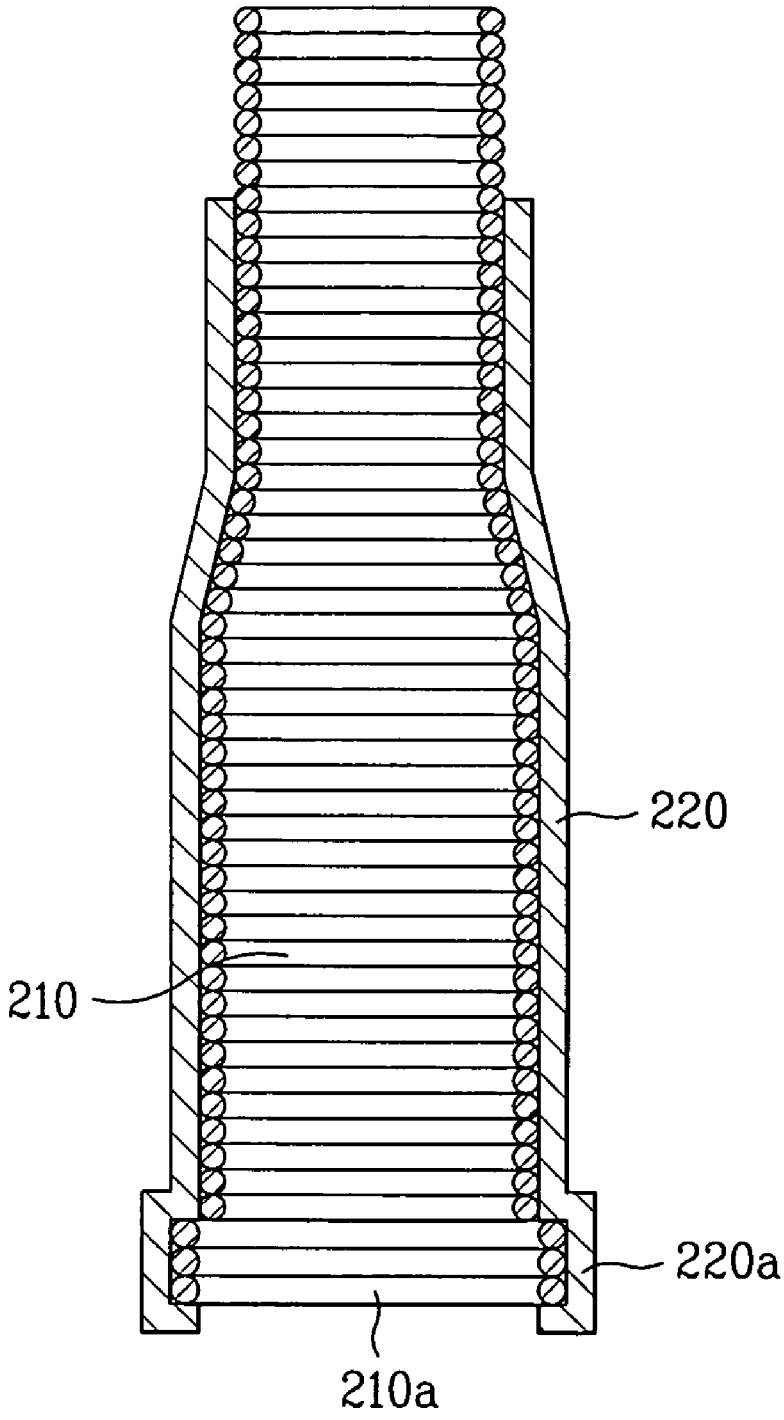
FIG. 5 illustrates a section of a third embodiment suction muffler connector in a compressor of the present invention.

FIG. 5 illustrates a third embodiment suction muffler connector 200 having a connection pipe 220 with a holding part 220*a* for inserting the enlarged part 210*a* therein of the connection spring illustrated in FIG. 4.

The holding part 220*a* of the connection pipe 220 is projected outward from an outside circumferential surface of a lower end of the connection pipe, with an annular recess therein for holding the enlarged part 210*a* of the connection spring 210.

That is, when the enlarged part 210*a* of the connection spring 210 is inserted to an inside of the holding part 220*a* of the connection pipe, the connection spring 210 can be held by the connection pipe 220 more firmly.

Next, a fourth embodiment of the suction muffler connector of the present invention will be described, with reference to FIG. 6.

Figure 6:
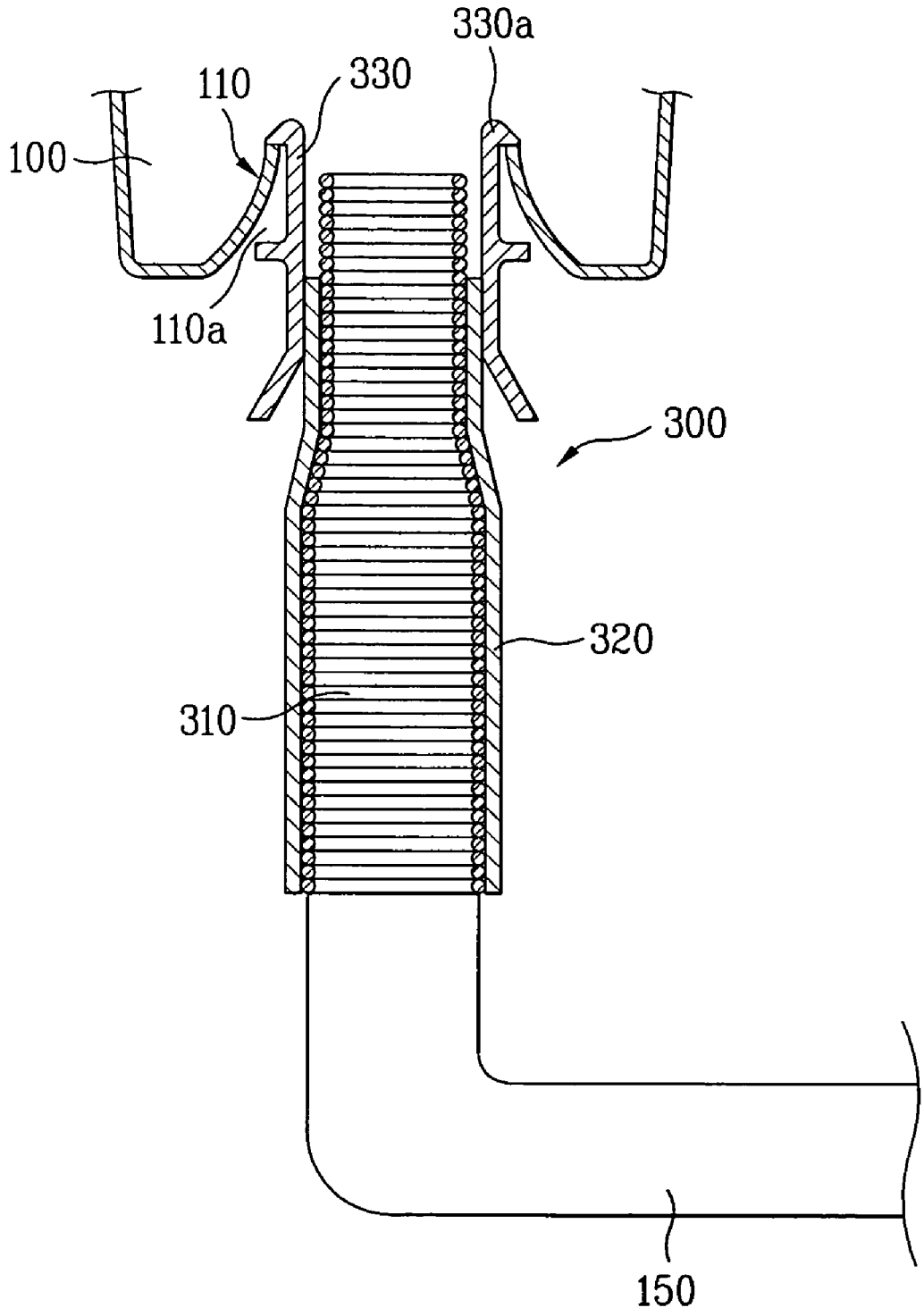
FIG. 6 illustrates a section of a fourth embodiment suction muffler connector in a compressor of the present invention.

Referring to FIG. 6, a suction muffler 100 includes the inlet part 110 to the suction muffler described in the first embodiment at one side thereof. There is a suction muffler connector 300 between the inlet part 110 of the suction muffler 100 and the suction pipe 150 for guiding refrigerant from the suction pipe 150 to the suction muffler 100.

The suction muffler connector 300 has one end connected to a top end of the suction pipe 150, and the other end having a connection spring 310 extended to the inlet part 110 of the suction muffler 100, a connection pipe 320 surrounding an outside circumferential surface of the connection spring for preventing exposure of the connection spring 310, and a connection cap 330 held both at the top of the connection pipe 320 and the inlet part of the suction muffler. It is preferable that the connection cap 330 is a plastic of an elastic material, such as rubber.

The connection cap 330 has a hook 330*a* for hooking the top end of the inlet part of the suction muffler, such that the connection cap 330 is held at the suction muffler 100 if top of the connection cap 330 is inserted in the inlet part 110 of the suction muffler and pushes up.

A process for mounting the suction muffler connector 300 in accordance with a third preferred embodiment of the present invention between the suction muffler 100 and the suction pipe 150 will be described.

The connection cap 330 is inserted in, and held at the inlet part 110 of the suction muffler 100 fastened to the frame. Then, the connection spring 310 with the connection pipe 320 is fixed to the suction pipe 150 passed through one side of the shell 1.

Next, if the connection cap 330 held at the inlet part 110 of the suction muffler moves down to insert the connection pipe 320 with the connection spring 310 into the connection cap 330, the suction muffler connector 300 connects the suction pipe and the suction muffler.

According to above structure, the refrigerant can be introduced from the suction pipe 150 to the suction muffler 100 through the suction muffler connector, directly.

The suction muffler and the compressor therewith have the following advantages.

First, the connection pipe covering the outside circumference of the connection spring to prevent exposure of the connection spring prevents leakage of refrigerant introduced into the suction muffler through the suction pipe even if the connection spring vibrates due to vibration of the compressor.

Second, the insertion of the connection spring in the connection pipe to hold the connection spring with the connection pipe provides an insulating effect, to avoid the refrigerant flowing in the suction muffler connector heated by heat in the shell, and increase the compression efficiency.

Third, there is no gap at the connection spring as the connection spring is inserted in the connection pipe. Therefore, even if the suction muffler vibrates due to operation of the compressor, leakage of noise between the connection spring is prevented.

Fourth, the connection cap between the connection pipe and the suction muffler, to prevent formation of a gap between the suction muffler connector and the suction muffler, permits leakage of refrigerant between the suction muffler and the suction muffler connector even if the suction muffler shakes by the vibration of the compressor, and a quiet operation of the compressor as leakage of noise is also prevented.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A suction muffler connector in a compressor having a suction pipe for guiding refrigerant into the compressor, and a suction muffler for attenuating noise of the refrigerant in the suction pipe, comprising:

a connection spring having one side connected to the suction pipe for guiding the refrigerant to the suction muffler; and a connection pipe fitted to surround the connection spring for preventing exposure of an outside circumference of the connection spring, wherein the connection pipe comprises:

a first cylindrical section having a first diameter and having a top part held at an inlet to the suction muffler, a second cylindrical section having a second diameter that is larger than the first diameter, wherein an outer surface of the connection spring abuts inner surfaces of the first and second cylindrical sections, and wherein the connection spring includes an enlarged part having an outside diameter greater than an inside diameter of the second cylindrical section of the connection pipe, and a holding part having a cylindrical annular recess for holding the enlarged part of the connection spring, wherein the outer surface of the enlarged part of the connection spring abuts an inner surface of the cylindrical annular recess.

2. The suction muffler connector as claimed in claim 1, wherein the connection pipe is formed of an elastic material.

3. The suction muffler connector as claimed in claim 1, further comprising a connection cap between the connection pipe and a suction muffler inlet, for connecting the connection pipe to the suction muffler, wherein an outer surface of the first cylindrical section of the connection pipe abuts an inner cylindrical surface of the connection cap.

4. The suction muffler connector as claimed in claim 3, wherein the connection cap has an upper outside circumferential surface that is held by the inlet to the suction muffler.

5. The suction muffler connector as claimed in claim 3, wherein the connection cap includes a hook for hooking an inlet to the suction muffler.

6. The suction muffler connector as claimed in claim 3, wherein the connection cap is formed of an elastic material.

7. The suction muffler connector as claimed in claim 1, wherein the connection spring has an inside diameter of an upper part thereof of a suction muffler side smaller than an inside diameter of a lower part thereof.

8. The suction muffler connector as claimed in claim 1, wherein the connection spring has a sectional area for flow of refrigerant that becomes smaller as it goes upward to a suction muffler side.

9. The suction muffler connector as claimed in claim 1, wherein the connection spring has an upper part that extends beyond an upper end of the connection pipe and into an inside of the suction muffler.

10. The suction muffler connector as claimed in claim 1, wherein the enlarged part of the connection spring extends below a lower edge of the connection pipe.

11. The suction muffler connector as claimed in claim 1, wherein the annular recess has a diameter that is larger than a diameter of the remaining portions of the connection pipe.

12. A compressor comprising:

a compression part for drawing in low pressure refrigerant, compressing the refrigerant, and discharging the refrigerant;

a suction muffler for attenuating noise of the refrigerant introduced thereto, and discharging the refrigerant toward the compression part;

a suction pipe for guiding refrigerant from an outside of the compressor to the suction muffler; and a suction muffler connector for connecting the suction muffler and the suction pipe, wherein the suction muffler connector comprises:

a connection spring having one side connected to the suction pipe for guiding the refrigerant to the suction muffler, and a connection pipe fitted to surround the connection spring for preventing exposure of an outside circumference of the connection spring, wherein the connection pipe comprises:

a first cylindrical section having a first diameter and having a top part held at an inlet to the suction muffler, and a second cylindrical section having a second diameter that is larger than the first diameter, wherein an outer surface of the connection spring abuts inner surfaces of the first and second cylindrical sections, and wherein the connection spring includes an enlarged part having an outside diameter greater than an inside diameter of the second cylindrical section of the connection pipe, and a holding part having a cylindrical annular recess for holding the enlarged part of the connection spring, wherein the outer surface of the enlarged part of the connection spring abuts an inner surface of the cylindrical annular recess.

13. The compressor as claimed in claim 12, further comprising a connection cap between the connection pipe and a suction muffler inlet, for connecting the connection pipe to the suction muffler, and wherein an outer surface of the first cylindrical section of the connection pipe abuts an inner cylindrical surface of the connection cap.

14. The compressor as claimed in claim 13, wherein the connection cap has an upper outside circumferential surface that is held by the inlet to the suction muffler.

15. The compressor as claimed in claim 13, wherein the connection cap includes a hook for hooking an inlet to the suction muffler.

16. The compressor as claimed in claim 12, wherein the connection spring has an inside diameter of an upper part thereof of a suction muffler side smaller than an inside diameter of a lower part thereof.

17. The compressor as claimed in claim 12, wherein the enlarged part of the connection spring extends below a lower edge of the connection pipe.

18. The compressor connector as claimed in claim 12, wherein the annular recess has a diameter that is larger than a diameter of the remaining portions of the connection pipe.

19. The compressor as claimed in claim 12, wherein an upper part of the connection spring extends above an upper end of the connection pipe and into the suction muffler.

* * * * *